US005997354A

United States Patent [19]

Fülöp et al.

[11] Patent Number: 5,997,354

[45] Date of Patent: Dec. 7, 1999

[54] PLASTIC HOUSING AND BASE CONSTRUCTION ESPECIALLY FOR COMPACT FLUORESCENT LAMPS AND ELECTRONIC OPERATING UNITS THEREOF

[75] Inventors: József Fülöp, Budapest; Sándor Lukács, Veröce; Zoltán Vámos, Budapest; István Würsching, Budapest; Ferenc Papp, Budapest; Erzsébet Cserteg, Budapest; József Tökés, Budapest; Ákos Ocsovai, Budapest; Kálmán Antal, Budapest, all of Hungary

[73] Assignee: General Electric Company, Schenectady, N.Y.

[21] Appl. No.: 09/123,396

[22] Filed: Jul. 13, 1998

[30] Foreign Application Priority Data

Aug. 1, 1997 [HU] Hungary ..... 9701338

[51] Int. Cl.[6] ..... H01R 17/00

[52] U.S. Cl. ..... 439/615; 439/339; 439/662; 313/318.01

[58] Field of Search ..... 313/318.01, 318.09; 439/611, 613, 615, 339, 340, 662, 666

[56] References Cited

U.S. PATENT DOCUMENTS 2,444,278 6/1948 Betts .
3,775,634 11/1973 Hasell et al. ..... 313/318.01
4,029,387 6/1977 Eager .
4,683,402 7/1987 Aubrey .
5,568,009 10/1996 Gandhi ..... 313/318.1

*Primary Examiner*—Khiem Nguyen
*Attorney, Agent, or Firm*—Fay, Sharpe, Fagan, Minnich & McKee, LLP

[57] ABSTRACT

Plastic housing and base construction, especially for compact fluorescent lamps and operating units thereof comprising a housing (1) which is a cup-like body and a base (2) having a metal base shell (26) and at least one metal central (3) or end contact part (4, 5). The base shell (26) is electrically insulated from the central (3) or end contact parts (4, 5). The base (2) also includes a plastic insert body (20) which is open at its upper end and closed at least partially at its lower end. The diameters of the plastic insert body (20) decrease in at least one step and it has a cylindrical or slightly conical mantle portion (24) in the region of its upper end. The base shell (26) includes a thread-free opening portion (27) the inner diameter of which fits to the mantle portion (24) of and is pulled over and fixed to the plastic insert body (20). The metal central contact part (3) or each end contact part (4, 5) is fixed to the lower end of the insert body (20) which has a rim (22) at its upper end for connecting to the housing (1). The housing in turn has a connection end (11) for receiving the insert body (20).

4 Claims, 1 Drawing Sheet

Figure 2:
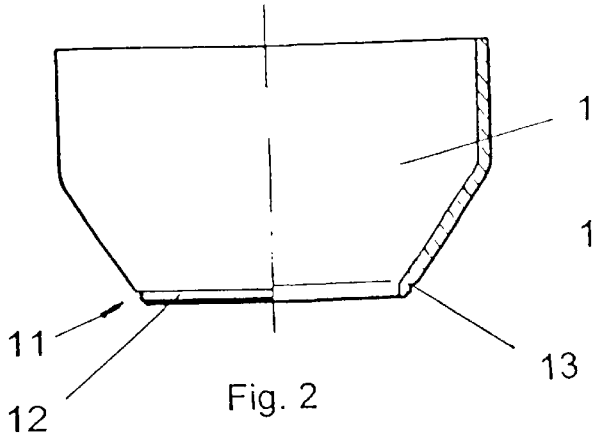

PLASTIC HOUSING AND BASE CONSTRUCTION ESPECIALLY FOR COMPACT FLUORESCENT LAMPS AND ELECTRONIC OPERATING UNITS THEREOF

This invention relates to a plastic housing and base construction, especially for compact fluorescent lamps and electronic operating units thereof. More particularly, it relates to a construction which allows standard base types of different dimensions and shape to be connected to uniform housings.

In the known constructions of electronic compact fluorescent lamps, the plastic housing of the fluorescent lamp is provided with a standard screw-in base or bayonet base depending on the customer's request. The bases are also different in their dimensions fitting to the plastic housing. The reason for this is the difference in standards developed during the history of particular fields of application and in diverse geographical places. The differences result in the need for housings of various dimensions and they also cause difficulties in making a reliable mechanical fixing for the base.

It is a further problem that the known conventional bases are filled with an insulator glass material called vitrite which, in addition to its insulation property, supports the base shell and the central or end contacts of the lamp. The quantity of vitrite material used cannot be decreased since the vitrite insert will crack because of rapid cooling at the end of the base-making process if this quantity is too small. Thus, vitrite material must be used in a sufficient quantity, which has the disadvantage that, when developing a construction of compact fluorescent lamps combined with electronic ballasts or operating units, insufficient space remains available for the construction elements of these ballasts or operating units. Experiments were carried out in order to adjust the quantity and spatial distribution of the vitrite material, i.e. the size and shape of the vitrite insert, so as to avoid its cracking during the base-making process, the subsequent assembly steps and the normal operation of the lamp or the operating unit and simultaneously to ensure sufficient space for some ballast elements inside the base. These experiments have shown that the above-mentioned objective requires a tooling with extremely narrow tolerances and a strict adherence to the instructions of the manufacturing process which in turn cause a substantial growth in manufacturing costs.

The objective of the present invention is to create a plastic housing and base construction which eliminates these disadvantages and deficiencies of the known designs.

Our invention is based on the recognition that the achievement of the objective set is highly promoted by constructing a vitrite-free base instead of the currently used bases with vitrite insert particularly for compact fluorescent lamps and the electronic operating units thereof. In this vitrite-free base, the vitrite insert is replaced by a plastic construction unit having properties significantly more compatible or even identical with those of the housing.

The objective set is achieved by a plastic housing and base construction comprising a housing which is a cup-like body and a base having a metal base shell and at least one metal central or end contact part. The base shell is electrically insulated from the central or end contact parts. The base also includes a plastic insert body which is open at its upper end and closed at least partially at its lower end. The diameters of the plastic insert body decrease in at least one step and it has a cylindrical or slightly conical mantle portion in the region of its upper end. The base shell includes a thread-free opening portion, the inner diameter of which fits to the mantle portion of and is pulled over and fixed to the plastic insert body. The metal central contact part or each end contact part is fixed to the lower end of the insert body which has a rim at its upper end for connecting to the housing. The housing in turn has a connection end for receiving the insert body.

The major advantages of the plastic housing and base construction according to the invention are that the slight wall thickness of the plastic insert body made by injection molding leaves a larger space in the base for the components of the electronic operating unit, the base, with the plastic insert body, has a higher mechanical strength compared to that of the conventional one with a vitrite insulator of glass material, and the source of shrinkage experienced currently and causing the break of vitrite during manufacture is eliminated. In addition, the number of plastic housing types can be substantially reduced and the type of base to be used can be decided or specified just before the final assembly.

In the following, the essential features of the invention will be shown by means of examples illustrating practical and preferred embodiments with reference to the figures of the attached drawing. In the drawing, FIG. 1 is a side-view sketch of the known plastic housing and base construction, FIG. 2 shows an example of the embodiment of the plastic housing according to the invention in semi-sectional view, FIG. 3 is a semi-sectional view of an example relating to the plastic insert body of the base to be connected to the housing shown in FIG. 2, and FIG. 4 is an exploded view of a first preferred arrangement showing a plastic insert body and standard base constructed according to the invention.

Figure 4:
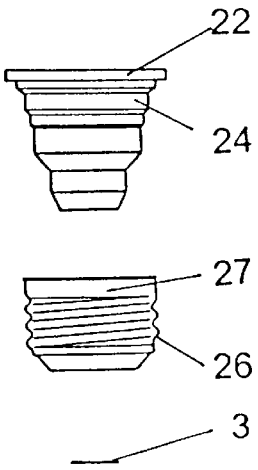
Figure 5:
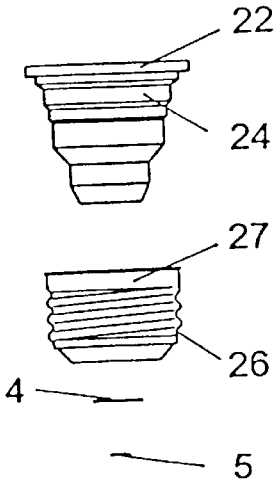
Figure 6:
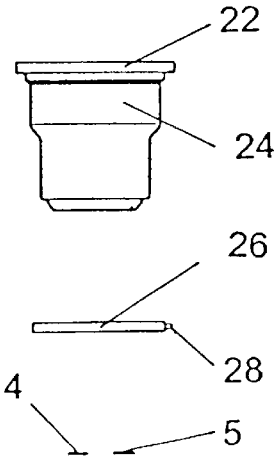

FIG. 5 is an exploded view similar to FIG. 4 showing the structure of another plastic insert body and standard base, and FIG. 6 is an exploded view of a bayonet base shell with a plastic insert body.

Figure 1:
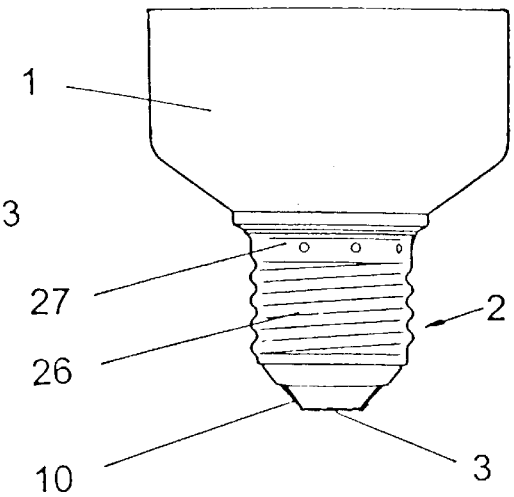

FIG. 1 of the attached drawing shows a side view of a known plastic housing and base construction for accepting the operating electronic unit of a compact fluorescent lamp (not shown), which construction also fixes the discharge tube of the compact fluorescent lamp in position in the case of integrated designs and is provided with a conventional Edison screw base 2 with vitrite-insulator. The base 2 has a shell 26 with a cylindrical opening portion 27 and a lower central contact 3 which are provided with an electrically insulating vitrite insert 10 pressed from a molten glass frit. The vitrite insert 10, due to reasons mentioned earlier, fills up a substantial part of the inner space of the base 2, and a small space is left in it for the components of the electronic operating unit of the fluorescent lamp. The base 2 is pushed over a lower end protrusion (not shown) of the housing 1, which protrusion is provided with a cylindrical mantle portion fitting to the inner diameter of the opening portion 27. According to the known solutions, the base 2 and the protrusion of the housing 1 can be fixed to each other by a mechanical joint and/or by some suitable adhesive joints. However, standard bases are various both in shape and size as a result of the differences in the luminaires developed historically in the particular markets and fields of applications with the consequence that the specified dimension of the inner diameter of the opening 27 of the base is also type-dependent. Owing to this, in the case of conventional plastic housing and base, housings 1 of various dimensions and shapes have to be manufactured and kept in stock depending on the actual orders.

Figure 3:
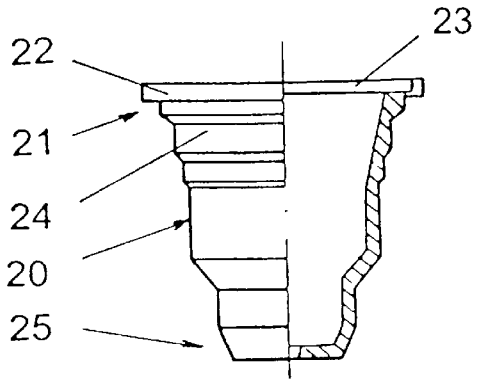

In contrast to this, FIG. 3 of the attached drawing shows an example for a plastic insert body 20 applied to the plastic housing and base according to the invention and intended to replace the vitrite insert 10 of the conventional base 2. The insert body 20 is an electrically insulating injection-molded plastic component, open at its upper end 21 and closed at least partially at its lower end 25, disregarding a central hole enabling an electrical connection lead to be passed. The said insert body 20 has the shape of a thin-walled body of rotation with a diameter decreasing in at least one step, and in the vicinity of the upper end 21, it has a cylindrical or slightly conical mantle portion 24 with fitted outer diameter. Assuming designs for identical base types, the inner space of the insert body 20 is significantly larger than that of the conventional bases with vitrite insert as a result of the wall thickness which can be kept at a sufficiently low value due to the plastic construction. At the open upper end 21 of the insert body 20, a rim 22 is formed which connects the insert body 20 to the plastic housing 1 (shown also in semi-sectional view in FIG. 2) in an oriented manner. In the embodiment shown, a recess 23 is indented into the said rim 22 which recess 23 has an inner diameter for accepting a cylindrical protrusion 12 of a connection end 11 of the housing 1 in a fitted manner. It is seen in FIG. 2 that the connection end 11 with dimensions and shape fitting to the rim 22 of the plastic insert body 20 is formed at the open end of the housing 1 connecting to the base 2. The housing 1 has a shape of a body of rotation comprising a cylindrical portion and a conical portion with a diameter decreasing toward the end of the housing 1. The protrusion 12 starting from a stop shoulder 13 and provided with a chamfer for making the connection easier is formed on this connection end 11.

FIGS. 4 through 6 for different types of base illustrate that a base shell 26 having a thread-free opening portion 27 with an inner diameter fitting to the mantle portion 24 of the plastic insert body 20 is pulled over the plastic insert body 20. The base shell 26 which has been pulled over the plastic insert body 20 can be fixed thereon using any known and suitable joint. Central contact part 3 or, with some types of base, end contact parts 4, 5 are fixed to the lower end 25 of the insert body 20 with suitable joints. The connection between the plastic insert body 20 and the metal parts can also be made in advance by providing the metal parts with suitable engaging claws or rims and by embedding them into the material of the insert body 20. These claws or rims are placed into the injection-molding tool making the plastic insert body 20.

FIG. 6 shows an example for a standard bayonet base with an insert body 20 designed according to the invention. The base shell 26 has no current conduction function in this case. At least one pin 28 ensures mechanical connection between the base 2 (i.e. the based light source) and a luminaire accepting the base 2. In the case of this base type, the base shell 26, requiring otherwise a substantial amount of metal material, can be replaced by a narrow metal ring supporting the pin 28 only which results from the construction according to the invention. FIGS. 4 through 6 also illustrate that the plastic insert bodies 20 of different dimensions and shapes, which support the metal parts of the particular standard base types, are in turn provided with rims 22 of identical dimensions and shape in order to form a pre-fabricated construction unit. As a result, it is sufficient to use and keep in stock housings 1 with connection ends 11 of the same dimensions and shape for the compact fluorescent lamps or operating units ordered with different base types. The rim 22 of the plastic insert body 20 can be fixed to the connection ends 11 of the plastic housing 1 using any known joint, especially a welded or adhesive joint. Fixing and subsequently connecting the connection leads of the compact fluorescent lamp or the operating unit to the metal parts of the base, i.e. the so-called lamp basing can be performed separately in space and time from the mass-production of the light source or the operating unit. Thus, the lamp basing can be performed e.g. in an importing country or at a wholesaler's plant site. This means a further advantage in addition to those which are obtained by making use of the invention and mentioned above.

We claim:

1. Plastic housing and base construction, especially for compact fluorescent lamps and electronic operating units thereof, comprising a housing (1) being a cup-like body; a base (2) having a metal base shell (26) and at least one metal central or end contact part; said base shell (26) being electrically insulated from said central or end contact part, wherein said base (2) includes a plastic insert body (20) being open at the upper end (21) and closed at least partially at the lower end (25) thereof and having diameters decreasing in at least one step and a cylindrical or slightly conical mantle portion (24) in the region of the upper end (21) thereof; said base shell (26) includes a thread-free opening portion (27) with an inner diameter fitting to said mantle portion (24) and being pulled over and fixed to said insert body (20); said central contact part (3) or each end contact part (4, 5) is fixed to the lower end (25) of said insert body (20); said insert body (20) has a rim (22) at the upper end thereof for connecting to said housing (1); said housing (1) has a connection end (11) for receiving said insert body (20).

2. Plastic housing and base construction of claim 1 in which a cylindrical protrusion (12) starting from a stop shoulder (13) and provided with a chamfered rim is formed at said connection end (11) of said housing (1) while a recess (23) with an inner diameter fitted for accepting said cylindrical protrusion (12) of said connection end (11) is indented into said rim (22) of said plastic insert body (20).

3. Plastic housing and base construction of claim 1 in which said rim (22) of said plastic insert body (20) is fixed to said connection end (11) of said plastic housing (1) with a welded or adhesive joint.

4. Plastic housing and base construction of claim 1 in which said plastic insert bodies (20) of different dimensions and shapes which support metal parts of particular standard base types, especially said base shell (26) and said central contact part (3) or each end contact part (4, 5) thereof, are in turn provided with rims (22) of identical dimensions and shape in order to form a pre-fabricated construction unit.

* * * * *